US006338678B1

(12) United States Patent
Seelig et al.

(10) Patent No.: US 6,338,678 B1
(45) Date of Patent: Jan. 15, 2002

(54) BALL SELECTOR AND DISPLAY DEVICE FOR USE WITH GAMING DEVICES

(75) Inventors: Jerald C. Seelig; Lawrence M. Henshaw, both of Pleasantville, NJ (US)

(73) Assignee: Atlantic City Coin & Slot Service Company, Inc., Pleasantville, NJ (US)

( * ) Notice: Subject to any disclaimer, the term of this patent is extended or adjusted under 35 U.S.C. 154(b) by 0 days.

(21) Appl. No.: 09/535,075

(22) Filed: Mar. 23, 2000

Related U.S. Application Data

(60) Provisional application No. 60/149,143, filed on Aug. 23, 1999, provisional application No. 60/151,257, filed on Aug. 27, 1999, and provisional application No. 60/178,047, filed on Jan. 24, 2000.

(51) Int. Cl.[7] ..... A63F 3/06

(52) U.S. Cl. ..... 463/17; 436/20; 436/22; 273/138.2; 273/144 R; 273/144 B

(58) Field of Search ..... 273/138.1, 138.2, 273/144 R, 144 A, 144 B; 463/17, 18, 19, 22, 20

(56) References Cited

U.S. PATENT DOCUMENTS 4,824,113 A * 4/1989 Lange ..... 273/144 B
4,871,171 A 10/1989 Rivero
5,088,737 A 2/1992 Frank et al.
5,380,007 A 1/1995 Travis et al.
5,566,940 A * 10/1996 Powell ..... 273/144 A
5,702,101 A * 12/1997 Russell ..... 273/144 B
5,848,932 A 12/1998 Adams

OTHER PUBLICATIONS

Virginia Lottery: Pick 4 Prizes Could Double, Oct. 1992.*

* cited by examiner

*Primary Examiner*—Benjamin H. Layno
(74) *Attorney, Agent, or Firm*—Ian F. Burns

(57) ABSTRACT

A ball selector and display device comprising a plurality of prize balls, a ball holder adapted to hold the balls in an individually controlled manner, a controller adapted to select a prize ball, a display mechanism adapted to display the selected prize ball to the player; and a positioning mechanism in communication with the controller adapted to position the selected prize ball relative to the display mechanism. The ball selector and display device may be combined with a jumbled ball display wherein the balls displayed by the ball selector and display device appear to originate from the jumbled ball display. The ball selector and display device may also be combined with a game apparatus that is adapted to allow players to play a game. In this embodiment, the ball selector and display device may provide a bonus award for the player. Several games are also provided that may be used with the ball selector and display device.

39 Claims, 8 Drawing Sheets

FIG. 1A
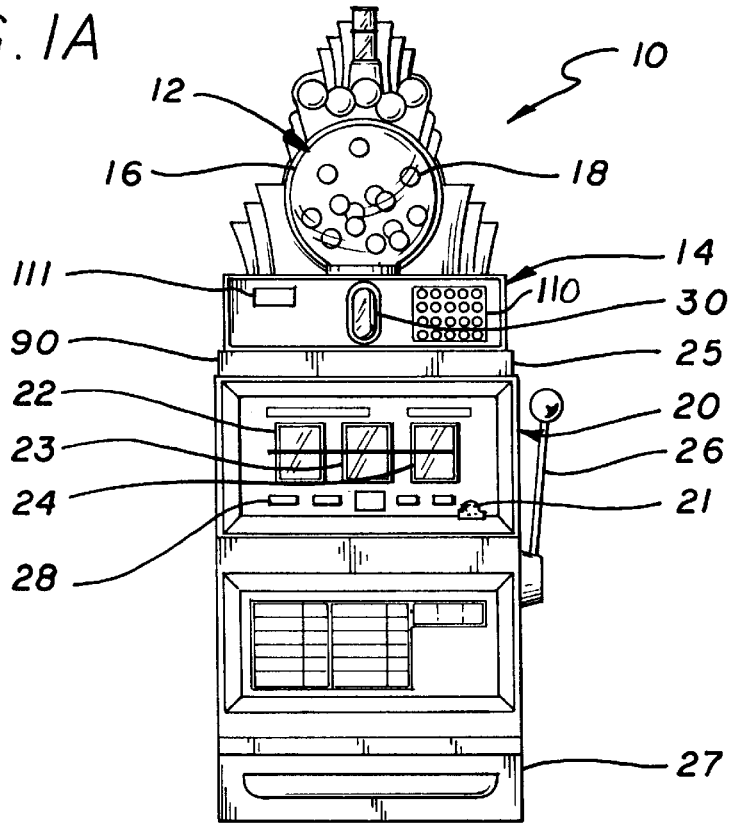
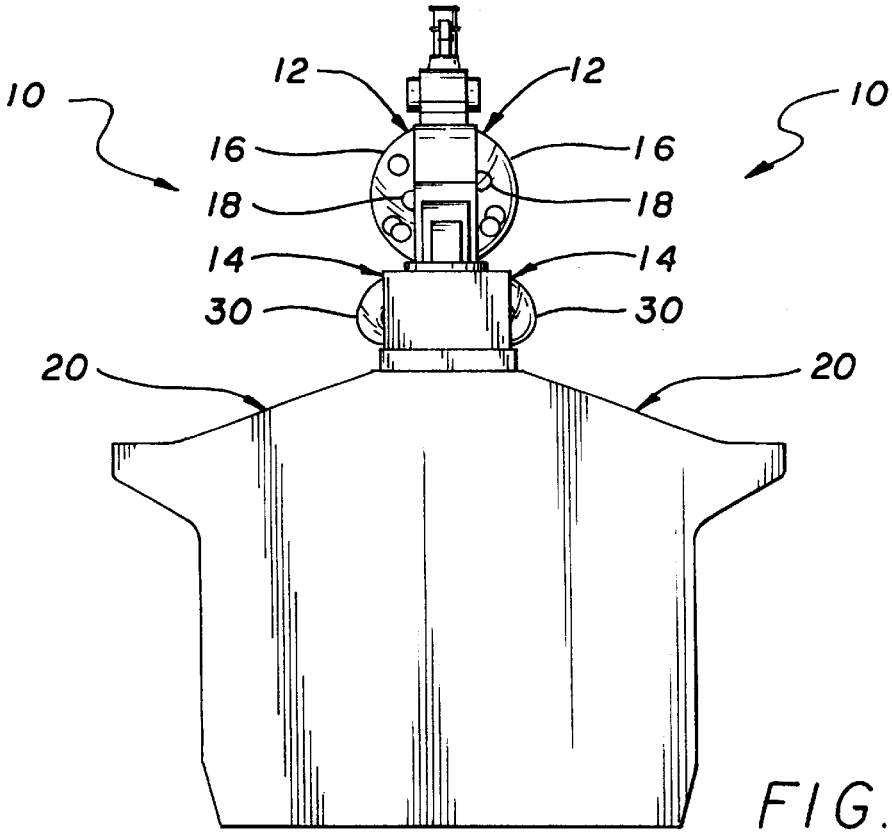
FIG. 1B

FIG. 3
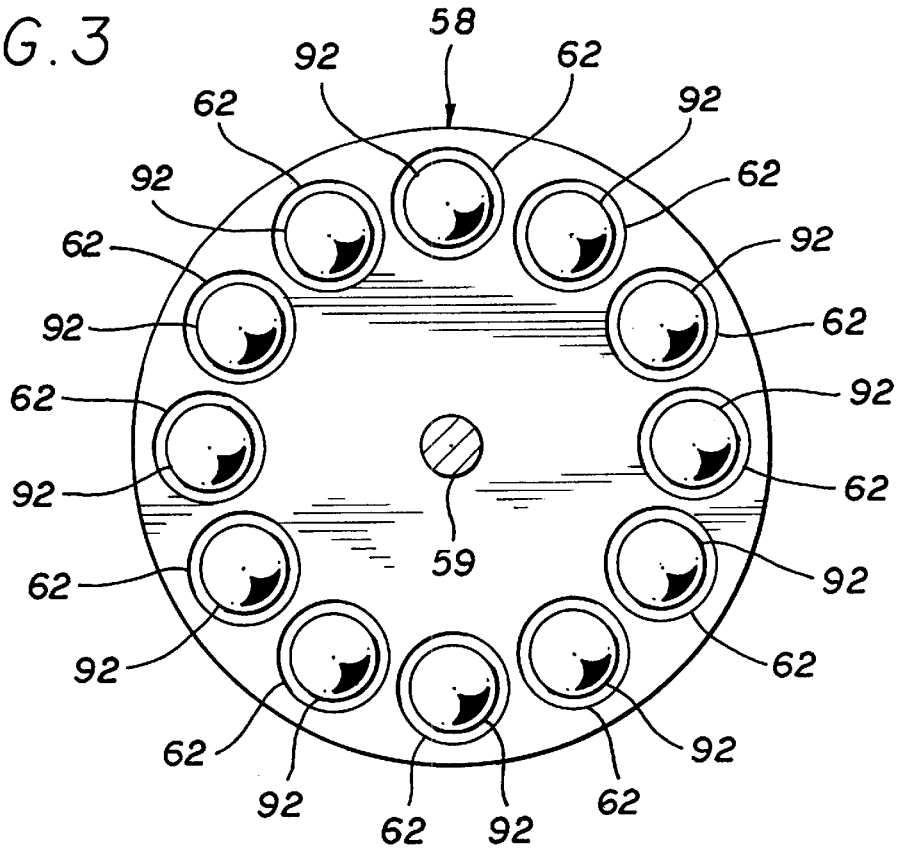
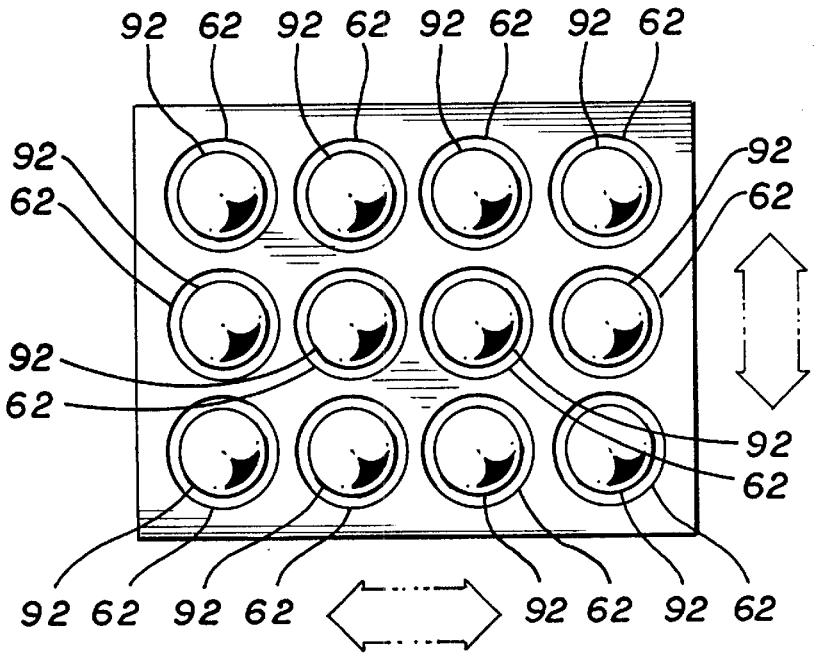
FIG. 4

FIG. 6
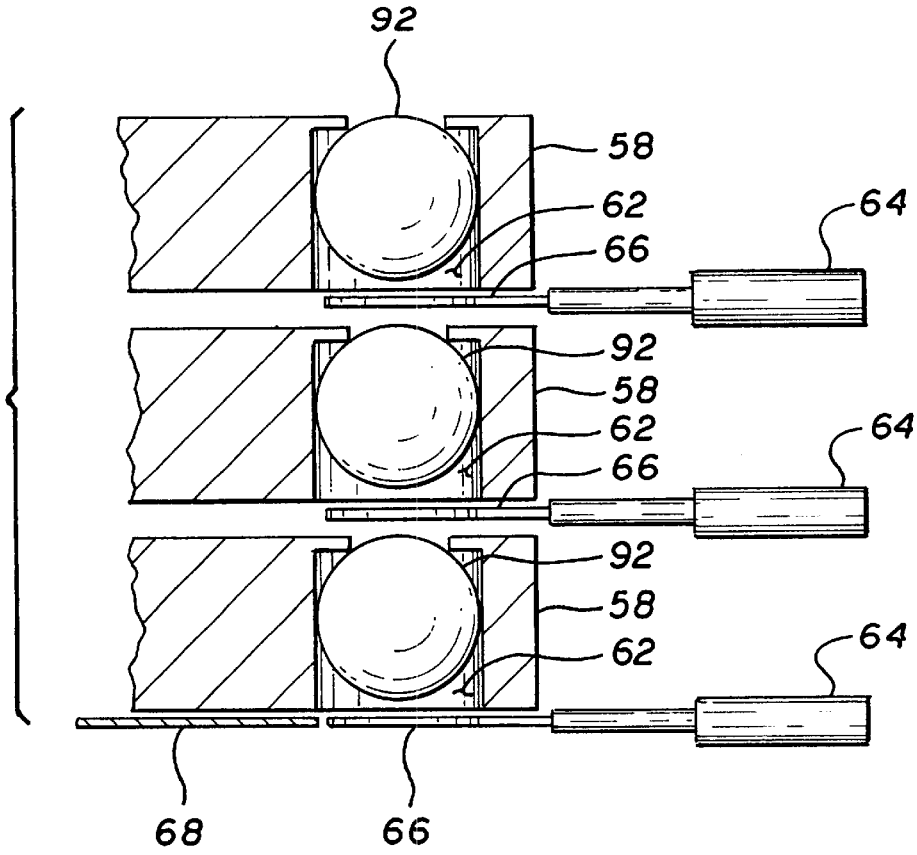
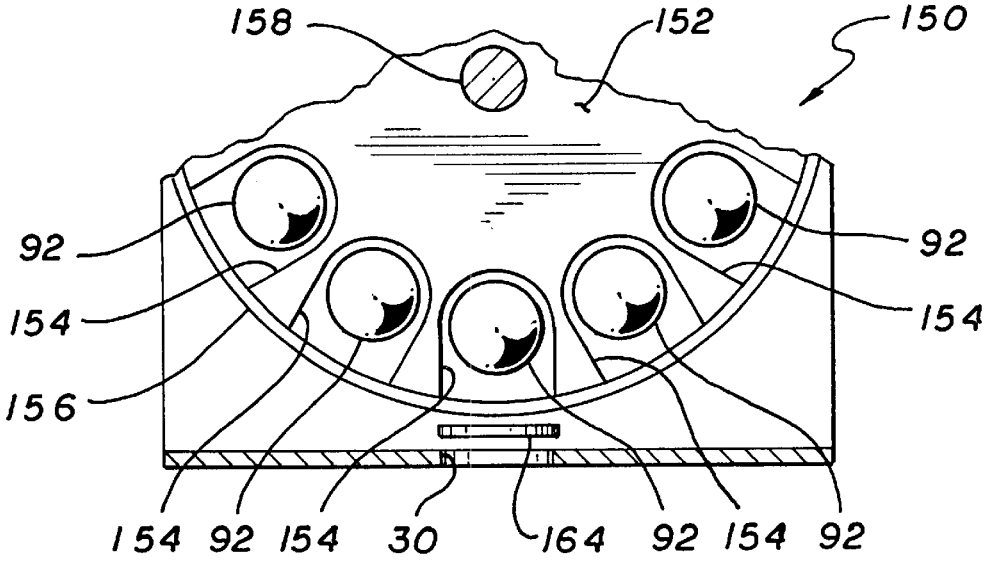
FIG. 7

FIG. 8
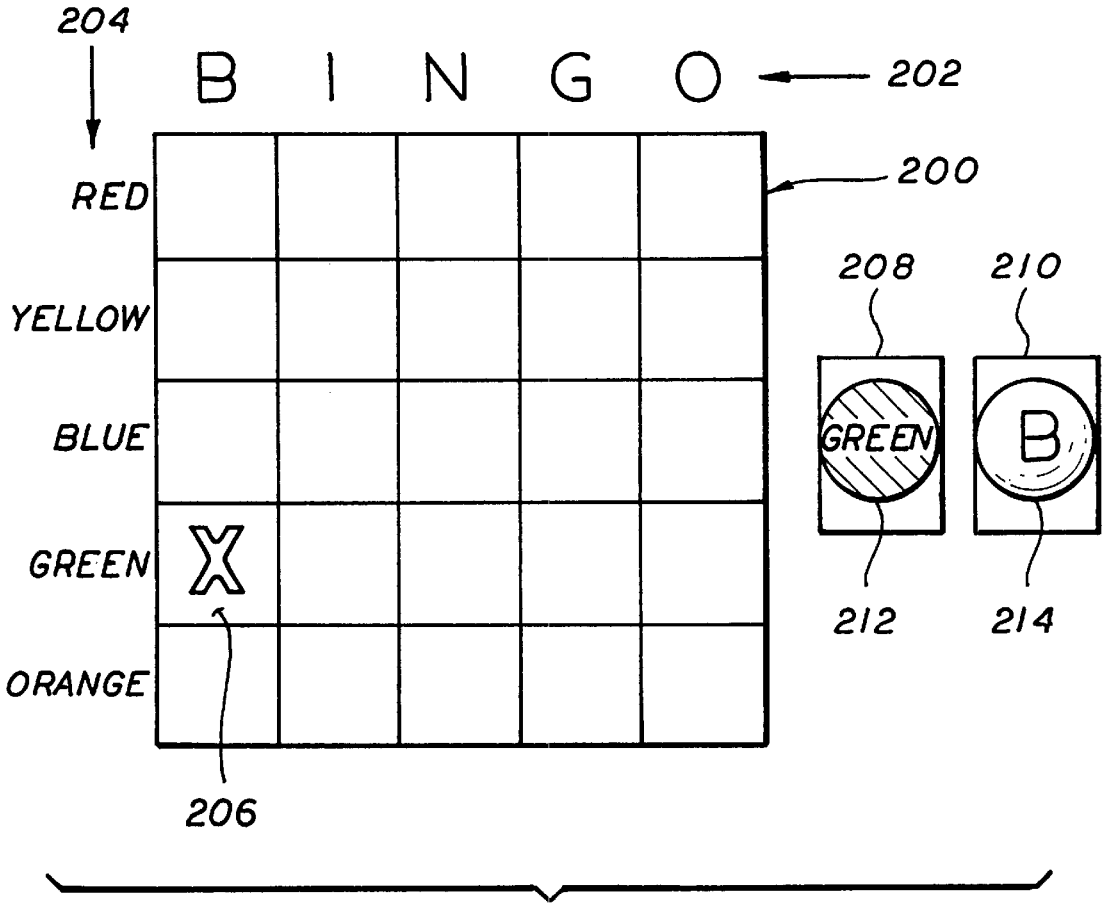
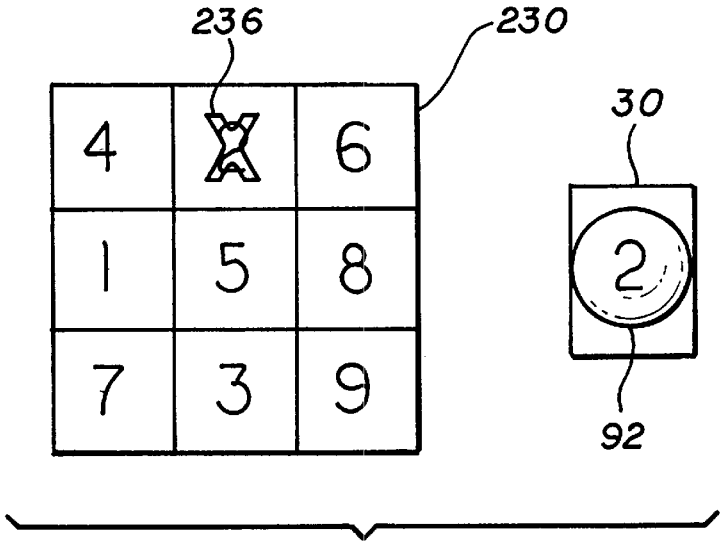
FIG. 9

BALL SELECTOR AND DISPLAY DEVICE FOR USE WITH GAMING DEVICES

CROSS REFERENCES TO RELATED APPLICATIONS

This application claims priority of and incorporates by reference U.S. provisional patent application No. 60/149,143, filed on Aug. 23, 1999, No. 60/151,257, filed on Aug. 27, 1999, and No. 60/178,047, filed on Jan. 24, 2000.

BACKGROUND OF THE INVENTION

1. Field of Invention

The present invention relates to a ball selector and display device for use with a gaming device that selects one or more balls from a plurality of individually controlled balls and displays the selected ball.

2. Description of Related Art

Gaming devices are well known in the art and a large variety of gaming devices have been developed. In general, gaming devices allow users or players to play a game. In many casino-type gaming devices, the outcome of the game depends, at least in part, on a randomly generated event. For example, a gaming device may use a random number generator to generate a random or pseudo-random number. The random number may then be compared to a predefined table to determine the outcome of the event. If the random number falls within a certain range of numbers on the table, the player may win a predefined prize. The table may also contain display information that allows the gaming device to generate a display that corresponds to the outcome of the game. The gaming device may present the outcome of the game on a large variety of display devices, such as mechanical spinning reels or video screens.

Some gaming devices award bonuses in addition to prizes that are awarded in the primary game. A bonus can be defined as an additional prize that is awarded to the player when a predefined event occurs. An example of a bonus game can be found in U.S. Pat. No. 5,848,932 issued to Adams. One of the gaming devices described in this document comprises three spinning reels and a spinning wheel bonus display. When predetermined indicia are displayed on the spinning reels of the primary game, the wheel can be activated to indicate a bonus prize. The bonus prize is awarded in addition to any prizes awarded in the primary game.

It has been found that bonus prizes increase the excitement and enjoyment experienced by players. This attracts more players to the game and encourages players to play longer, which in turn increases the commercial success of the gaming device.

It has been found that highly visible display devices increase the excitement and enjoyment experienced by players and they tend to attract more players. It is, therefore, desirable for gaming devices to incorporate highly visible display devices. It has also been found that gaming devices are more successful if they utilize a display device that is a derivation of a well-known game or theme.

Upon an initial examination, it would appear that the display device of Keno is an excellent choice for a display device for gaming devices. Keno is well known and it utilizes a highly visible and attractive display device. The display device comprises a container with a plurality of numbered balls. The balls in the container are agitated or jumbled, usually by a jet of air, to a state where they ricochet off of the walls of the container.

However, before the present invention, the Keno display device has been unsuitable for use with gaming devices. One of the reasons it has been unsuitable is that Keno is susceptible to environmental influences. An important aspect of any gaming device is resistance to environmental influences that could affect the results of the game. In the game of Keno, players select numbers that may be drawn from a Keno display device. The Keno display device jumbles or mixes numbered Keno balls in the container and then draws a predetermined number of balls from the container. Players are paid based on the number of balls drawn from the Keno display device that match the numbers they selected. However, as the balls are jumbled in the Keno ball device, static electricity, dust, and contaminants build up on the balls. This may cause the balls to stick to each other or to components in the display device thereby influencing the randomness of the game. Furthermore, the balls used in Keno displays may have slightly different weights or sizes that subtly affects the outcome of the game.

Another reason the game of Keno has been unsuitable as an indicator for a gaming device is that it requires a great deal of human involvement. In many Keno games, human operators are required to read the numbers of the Keno balls as they are selected and input the numbers into a computer or display. Furthermore, operators must regularly clean the Keno balls and the Keno devices to keep dust and contaminants from building up on the balls. Not only does this require far too much human involvement for an automated gaming device (the greater the human involvement, the greater the cost of operating the game), the game is also susceptible to tampering and cheating.

Because of its susceptibility to environmental influences and tampering and its dependence on human operators and maintenance personnel, Keno games are not allowed in at least one major gaming jurisdiction. Furthermore, these disadvantages have prevented Keno display devices and other devices that use jumbled balls from being adapted for use with gaming devices. What has long been needed is a means for adapting jumbled ball display devices for use with gaming devices. Although reference is made to the game of Keno, it is to be understood that the present invention may be used with almost any type of ball or jumbled ball display device.

SUMMARY OF INVENTION

Brief Description of the Invention

The present invention comprises a ball selector and display device for use with a gaming device. The ball selector and display device comprises a plurality of prize balls, a ball holder, a controller, a display mechanism, and a positioning mechanism. The ball holder is adapted to hold the prize balls in an individually controlled manner. The controller is adapted to select a ball in the holder and to control the positioning mechanism. The display mechanism is adapted to display the selected ball to the player. The positioning mechanism is in communication with the controller and it is adapted to position the selected ball relative to the display mechanism, whereby the display mechanism may display the selected ball. The ball selector and display device may be used with a jumbled ball display and a game apparatus.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

FIG. 1A is substantially a front view of gaming device of the present invention.

FIG. 1B is substantially a side view of an alternative embodiment of the gaming device of the present invention.

FIG. 3 is substantially a top cross sectional view of the preferred ball holder of the present invention taken along line III in FIG. 2.

FIG. 4 is substantially a top cross sectional view of an alternative ball holder of the present invention.

FIG. 6 is substantially a schematic diagram of an alternative embodiment of the present invention using multiple stacked ball holders.

FIG. 7 is substantially an alternative display mechanism of the present invention.

FIG. 8 is substantially a schematic representation of a bingo game that may be used with present invention.

FIG. 9 is substantially a schematic representation of an alternative bingo game that may be used with the present invention.

DESCRIPTION OF THE PREFERRED EMBODIMENT

Figure 2A:
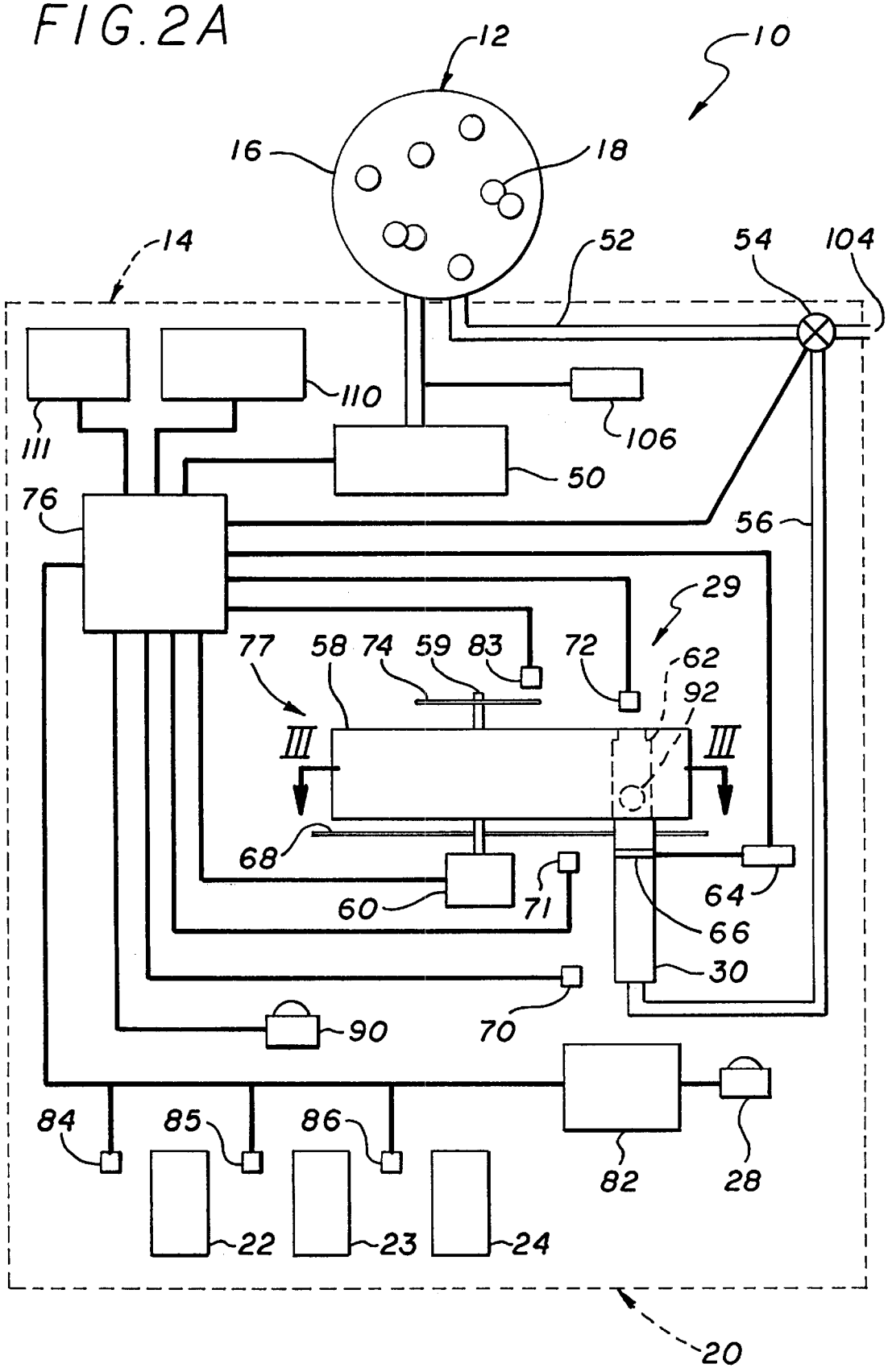
FIG. 2A is substantially a schematic diagram of the gaming device of the present invention.

As seen in FIG. 1A, the present invention comprises a gaming device, generally indicated by reference number 10. Gaming device 10 may comprise a jumbled ball display 12, a ball selection and display device 14, and a game apparatus 20.

Game Apparatus

Game apparatus 20 may be any of a large number of devices that are adapted to allow players to play a game. For example, game apparatus 20 may utilize spinning reels 22–24 or a video display (not shown) to display outcomes of the game. Means may also be provided for accepting wagers, such as a coin slot 21 or card reader 25, and for awarding prizes, such as a coin dispenser 27. A handle 26 and button 28 are provided for activating game apparatus 20 to begin a game. In at least one preferred embodiment, game apparatus 20 is an S Plus model gaming device available from International Game Technology in Reno, Nev.

Game apparatus 20 is preferably controlled by an electronic controller 82 (see FIG. 2) that utilizes a random number generator. The random number generator produces a random or pseudo random number for each game. The outcome of the game may be determined by comparing the random number to a table of outcomes. Game apparatus 20 then generates a display that is appropriate to the outcome of the game. It is recognized that game apparatus 20 may operate in many other ways and still achieve the objects of the present invention.

Game apparatus 20 may also comprises means for producing a bonus-activating event. This event may be many different types of events. For example, a bonus-activating event may comprise displaying a particular symbol, such as a "bonus" symbol, or combination of symbols, such as three "7" symbols, on reels 22–24. Furthermore, a bonus-activating event may occur when a player accumulates a number of symbols or game outcomes over a number of separate game plays. For example, a bonus-activating event may occur when the player receives three "bonus" symbols during a period of time.

Jumbled Ball Display

Jumbled ball display 12 comprises a container 16 that is adapted to hold a plurality of display balls 18. Container 16 is at least partially transparent allowing players to view display balls 18 inside of the container. In the preferred embodiment, container 16 is made of a transparent material, such as plastic or glass. Suitable containers of this type may be obtained from Tripp Plastics of Reno, Nev. However, container 16 may also be a wire cage of a type that is used in some Keno games.

Container 16 may have many different shapes, such as a sphere, cube, cylinder, triangle, etc. Although display balls 18 are preferably similar to Keno balls, many other types of balls may be used. For example, display balls 18 may be ping pong balls or rubber balls. Display 12 also comprises, an agitator (not shown in FIG. 1) to agitate or jumble display balls 18 within a container 16. The agitator may be a stream of air or a mechanical mixing device. The agitator causes the balls to bounce and ricochet off of the walls of container 16.

The purpose of jumbled ball display 12 is to attract and entertain players. When display balls 18 are agitated, they produce a vivid display that attracts the attention of people nearby and provides an exciting display for players playing gaming device 10. Display Balls 18 are preferably kept separate from balls used in ball selector and display device 14.

FIG. 1B represents an alternative embodiment of the present invention in which two gaming devices 10 are placed back to back. Game apparatuses 20 shown in FIG. 1B are known as "slant tops" for their sloping upper surfaces. However, other types of gaming devices may also be used. In this embodiment, independently operated jumbled ball displays 12 are provided for each game apparatus 20. Each jumbled ball display may comprise container 16 is the shape of a hemisphere. Containers 16 may be placed back to back so that the two containers have a spherical appearance when viewed from the side. Other shapes, such as cubes and cylinders, may also be used. A mirror may be placed at the back of each container 16 to enhance the appearance of the jumbled ball displays 12 by reflecting images of jumbled display balls 18 outward toward the players. Containers 16 may also be one single container that is divided in two by a mirror or other partition. Each container 16 has its own independently operated agitator and jumbled display balls 18. Each game apparatus 20 has its own independently operated ball selector and display device 14 with display window 30.

Ball Selector and Display Device

Ball selector and display device 14 is adapted to select a prize ball and display the ball to a player. When a bonus activating event occurs, selector 14 senses this, selects a ball, and displays the ball in a display window 30.

Turning now to FIG. 2, selector and display device 14 comprises a controller 76 that is adapted to control the operation of the device. Controller 76 may be one or more computers or processor boards. For example, in the presently implemented embodiment, controller 76 comprises a bonus controller and stepper motor controller, that may be purchased from Progressive Solutions in Carmichael, Calif., core module from Z-World in Davis, Calif., and a sound board Cleverdevices in Syosset, N.Y. Other, equally suitable devices may be purchased from other manufacturers. It is recognized that controller 76 may be a single processor or processor board. Furthermore, it is also recognized that controller 76 and controller 82 may be combined in a single processor or processor board.

Controller 76 is adapted to detect when a bonus activating event occurs in game apparatus 20. This may be accomplished by game apparatus controller 82 transmitting a signal to controller 76 that a bonus event has occurred. For example, controller 82 may determine the outcome of each game and when a bonus activating outcome occurs, it transmits a signal to controller 76. Alternatively, controller 76 may periodically interrogate controller 82. In another embodiment, one or more sensors may be provided for determining if a bonus activating event has occurred. For example, sensors 84–86 may sense the positions of reels 22–24. When reels 22–24 are in a bonus activating position, controller 76 would sense this and begin a bonus sequence.

When controller 76 detects a bonus activating event, it may begin a bonus sequence by activating display 110. Display 110 may comprise many different kinds of display devices, such as video screens, lights, light emitting diodes, etc. Display 110 may indicate that a player has qualified for a bonus round and prompt the player to perform an action. In the preferred embodiment, the player is prompted to activate the bonus sequence by pressing input device 90. Input device 90 may be a simple button, a keyboard, or a touch screen display. In the embodiment in which the player must accumulate a number of bonus symbols to qualify for a bonus, display 110 may indicate the number of symbols the player has received.

When controller 76 detects input device 90 being activated, the controller would activate the agitator in keno display 12. In the preferred embodiment, the agitator comprises blower 50, which blows air into container 16. Alternatively, the agitator may begin automatically and input device 90 may be used to initiate the display sequence. In another embodiment, controller 76 may wait a predetermined time period for the player to activate input device 90. If the player does not activate input device 90 in that time period, controller 76 would automatically activate the display 12 and initiate the display sequence. In yet another embodiment, controller 76 automatically initiates the display sequence in a predetermined time period, independent from input device 90, and input device 90 is only used to activate the jumbled ball display 12. Of course, no input device may be used and controller 76 may automatically activate display 12 and begin the display sequence.

To display a prize ball, controller 76 performs a routine to determine which ball will be displayed. This may be performed by a number of methods that are well known in the art. In the preferred embodiment, controller 76 generates a random number and then compares the random number to a pay table. A simple pay table may appear as follows:

| Random Number | Prize Ball Number | Amount Paid |
|---|---|---|
| 0.00 to 0.50 | 1 | $1.00 |
| 0.51 to 0.75 | 2 | $5.00 |
| 0.76 to 0.95 | 3 | ×2 |
| 0.96 to 1.00 | 4 | $1,000.00 |

For example, if the random number generator produced 0.65, prize ball number 2 would be displayed and $5.00 would be awarded to the player. If the random number generator produced 0.80, prize ball number 3 would be displayed. Prize ball number 3 is a multiplier ball that multiplies some amount produced by device 10. Gaming apparatus 20, for instance, may award $20 and the multiplier ball would multiply this by two, awarding the player $40.

The present invention is not limited to the example pay table shown. A greater number of prize balls may be used and, as will be discussed below, a combination of prize balls may be displayed. Furthermore, different kinds of prizes may be awarded. For example, the prizes may be goods, services, or additional games. The goods and services may be awarded in the form of physical objects, tickets, vouchers, coupons, etc. Additional games may be presented in the form of tickets, such as scratch off lottery tickets. In the embodiments in which tickets, vouchers, and coupons are used, the objects are dispensed using an internally or externally mounted dispenser 111.

Once controller 76 determines the prize ball to be displayed and the prize to be awarded, the controller activates a positioning mechanism 77. Positioning mechanism 77 is adapted to position the selected ball so that it can be displayed. Positioning mechanism 77 may utilize a large variety of devices to achieve its purpose. In the preferred embodiment, all of the prize balls are held in a ball holder 58. Ball holder 58 may be made from a variety of materials, such as plastics, metals, or composites. Prize balls 92 preferably have a similar appearance to display balls 18 in container 16. This creates the illusion that balls displayed in display window 20 originate from container 16. At least one of prize balls 92 have a symbol that is capable of indicating a prize to be awarded to the player.

Prize balls 92 are stored in ball holder 58 in an individually controlled manner so that individual balls can be selectively removed from the ball holder. This allows particular balls with particular symbols or values to be removed and displayed when desired. This may be accomplished in different ways. In the preferred embodiment, ball holder 58 comprises a chamber 62 for each prize ball 92 stored in the holder. A display mechanism 29 is provided for removing ball 92 stored in chamber 62, displaying the ball, and replacing it in the chamber.

In the preferred embodiment, ball holder 58 is cylindrical as illustrated in FIG. 3. Chambers 62 are positioned outward from a central axis 59 of ball holder 58, near the periphery of the holder. Thus, chambers 62 may be positioned by rotating ball holder 58 around its central axis 59.

Returning to FIG. 2, positioning mechanism 77 comprises a stepper motor 60 for rotating holder 58. Wheel 74, rigidly attached to holder 58, and sensor 83, not attached to the holder, are provided for determining the angular position of the holder. Thus, controller 76 can position a ball 92 in holder 58 where it can be removed and replaced by rotating the holder and monitoring its angular position. The angular position of each prize ball 92 is stored in memory in controller 76. Sensor 83 may be an infrared source and detector and the periphery of wheel 74 may comprise portions with different reflective characteristics, such as physical holes or gaps or absorbent paint lines.

Ball holder 58 may be provided in different configurations. For example, as shown in FIG. 4, ball holder 61 may be square or rectangular with chambers 62 arranged in rows and columns. In this embodiment, controller 76 is programmed with the location of chambers 62 and ball holder 61 is positioned by moving it laterally and longitudinally.

Figure 5A:
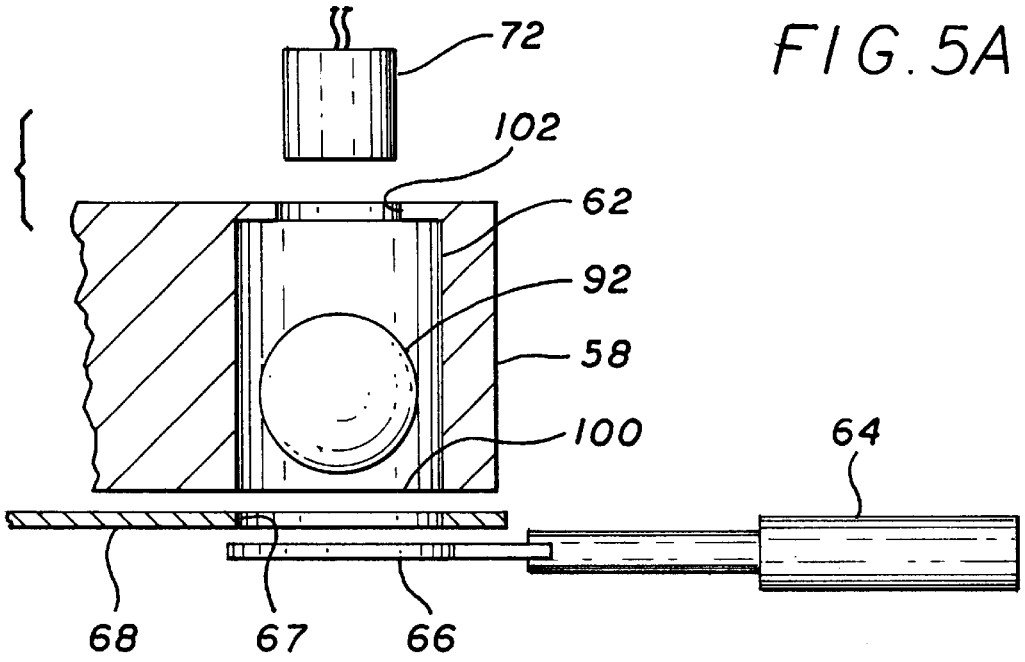
FIG. 5A is substantially an enlarged view of the ball holder shown in FIG. 2.

In the preferred embodiment, holder 58 is arranged to allow the force of gravity to remove balls 92 from the holder. Referring now to FIGS. 2 and 5A, each chamber 62 has a lower opening 100 that is large enough for prize ball 92 to pass through. A plate 68 is provided on the lower surface of holder 58 for preventing prize balls 92 from falling out of chambers 62. A hole 67 is provided in one portion of plate 68 for allowing ball 92 to pass through the plate. A gate 66 blocks ball 92 until it is opened by an actuator 64. Gate 66 may cover the entire hole 67 or just a portion of it and it may be operated in a sliding or hinged manner. Actuator 64 may be an electrical solenoid actuator.

Figure 5B:
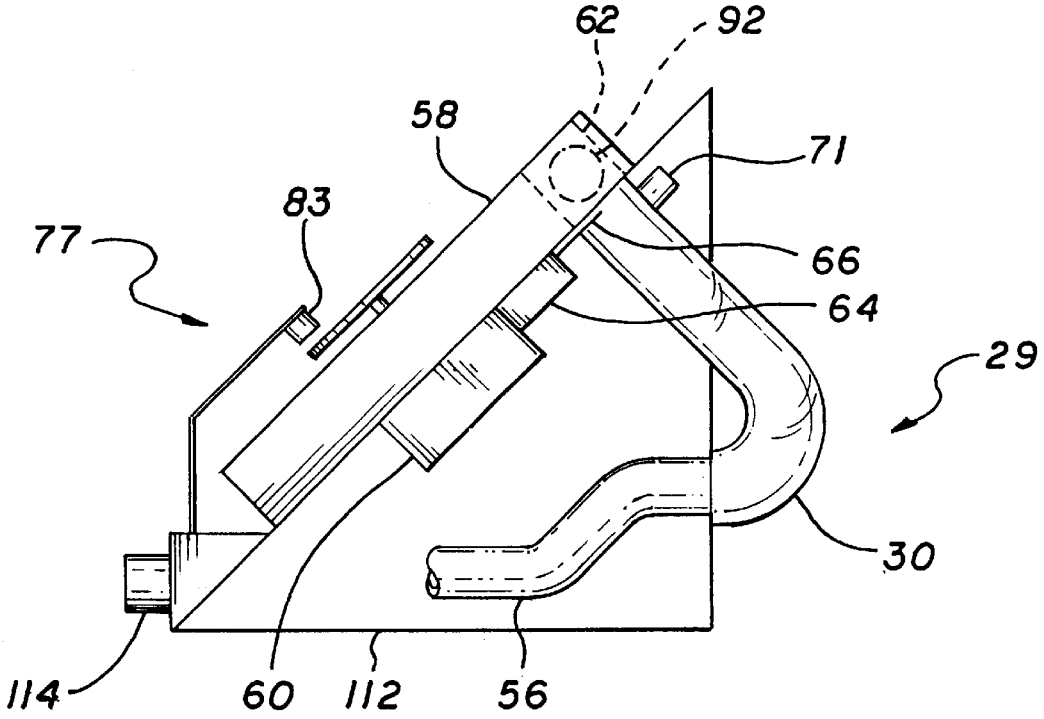
FIG. 5B is substantially a side elevational view of the positioning and display mechanisms of the preferred embodiment of the present invention.

FIG. 5B represents a preferred embodiment in which a chassis 112 supports ball holder 58 at approximately a forty five degree angle to the vertical. Mounting grooves (not shown) may not be provided in display device 14 for slidably receiving chassis 112 and connector 114 may be provided for connecting electrical circuits and devices to power supplies and controller 76. One of the advantages of this embodiment is that positioning mechanism 77 and display mechanism 29 can be easily serviced by removing chassis 112 from display device 14.

In normal operation, after controller 76 has determined which ball is to be displayed, the controller rotates holder 58 until the desired prize ball 92 is positioned over the plate hole 67. At the appropriate time, controller 76 activates actuator 64 to open gate 66. The force of gravity then pulls prize ball 92 downward into display window 30. Display window 30 may be a chamber with a transparent or partially transparent wall that allows the player to see ball 92. In the preferred embodiment, display window 30 comprises a tube that projects outward from the front surface of selector and display device 14. This allows players to view prize ball 92 from many different angles and see symbols on the ball. Sensors 70 and/or 71 may be used to verify that prize ball 92 has fallen into display window 30. If sensors 70 and/or 71 do not detect ball 92 in its proper position, controller 76 may enter an error mode.

If the ball is detected in its proper position, controller 76 may cause display 110 to display the prize, if any, that the player has won. Other effects may also be presented, such as pre-recorded sound from speakers. If the actual prize is money, the amount of the prize may be added to the player's credit meter or the prize may be dispensed from dispenser 111.

After ball 92 has been displayed long enough, controller 76 operates a valve 54 to divert exhaust air from container 16. While blower 50 is in operation, air is allowed to escape container 16 through an exhaust duct 52. Valve 54 is used to divert air from a vent 104 to a display duct 56. Display duct 56 directs air to the bottom of display window 30 where it blows the ball 92 upwards back into chamber 62. An upper opening 102 (see FIG. 5) is provided in chamber 62 for allowing air to escape from the chamber thereby producing an air current. Sensors 72 and/or 71 may be used to verify that ball 92 has returned to chamber 62. If the ball is not detected in its proper position, controller 76 may enter an error mode.

It is recognized that the components of the present invention may be arranged so that ball display window 30 is located above holder 58 and ball 92 is blown upwards into the display. When valve 54 is closed, the force of gravity pulls ball 92 back into chamber 62.

Once ball 92 has returned to chamber 62, controller 76 closes gate 66 by activating actuator 64, turns off blower 50, and waits for the next activating event.

Because some balls are very light, static electricity can cause the balls to stick to each other and to other components. To prevent this, a variety of static discharge devices 106 may be placed in various locations in the present invention.

Selector and display device 14 of the present invention may also comprise means for simultaneously displaying a plurality of balls 92. To accomplish this, plate 68 may have multiple holes 67, each with its own gate 66 and actuator 64, for supplying balls to multiple display windows. Thus, holder 58 may be positioned so that the appropriate ball is positioned over the appropriate hole 67 for supplying the appropriate display window 30. Alternatively, a plurality of ball holders 58 may be provided, each one supplying balls to a separate display window 30.

In yet another embodiment, seen in FIG. 6, a plurality of separately controlled ball holders 58 are arranged in a stack. Each ball holder 58 is rotated to a position so that chambers 62 are aligned above display window 30. Gates 66 are then opened and balls 92 are allowed to fall into display window 30. In this embodiment, display window 30 is large enough to display three balls simultaneously. When the display period has ended, balls 92 are blown back into chambers 62 and gates 66 are closed to separate and contain the balls.

With multiple balls being displayed it is possible to use combinations of balls to indicate various bonus outcomes. It is also possible to replace the primary display of a gaming device with selector and display device 14. In other words, game apparatus 20 may be entirely replaced with selector and display device 14.

As seen in FIG. 7, the present invention comprises an alternative display mechanism 150. Display mechanism 150 comprises a cylindrical ball holder 152 that may be rotated around its central axis 158. Ball holder 152 comprises a plurality of chambers 154 positioned along the periphery of the holder, each chamber is adapted to hold ball 92. Unlike the embodiment described in FIG. 2, it is not necessary to remove and replace balls 92 from chambers 154. Instead, at least a portion of the outer wall of each chamber 154 comprises a transparent material that allows players to view balls 92 inside the chamber. The transparent wall may comprise a ring of transparent material 156 that surrounds holder 152. A shutter device or door 164 maybe provided between display window 30 and holder 152 for blocking the view of players while the holder is rotated. Although this embodiment has the advantage of a simpler mechanism, it may be less entertaining to players because it may be more apparent to the players that balls 92 do not originate from jumbled ball display 12.

Figure 2B:
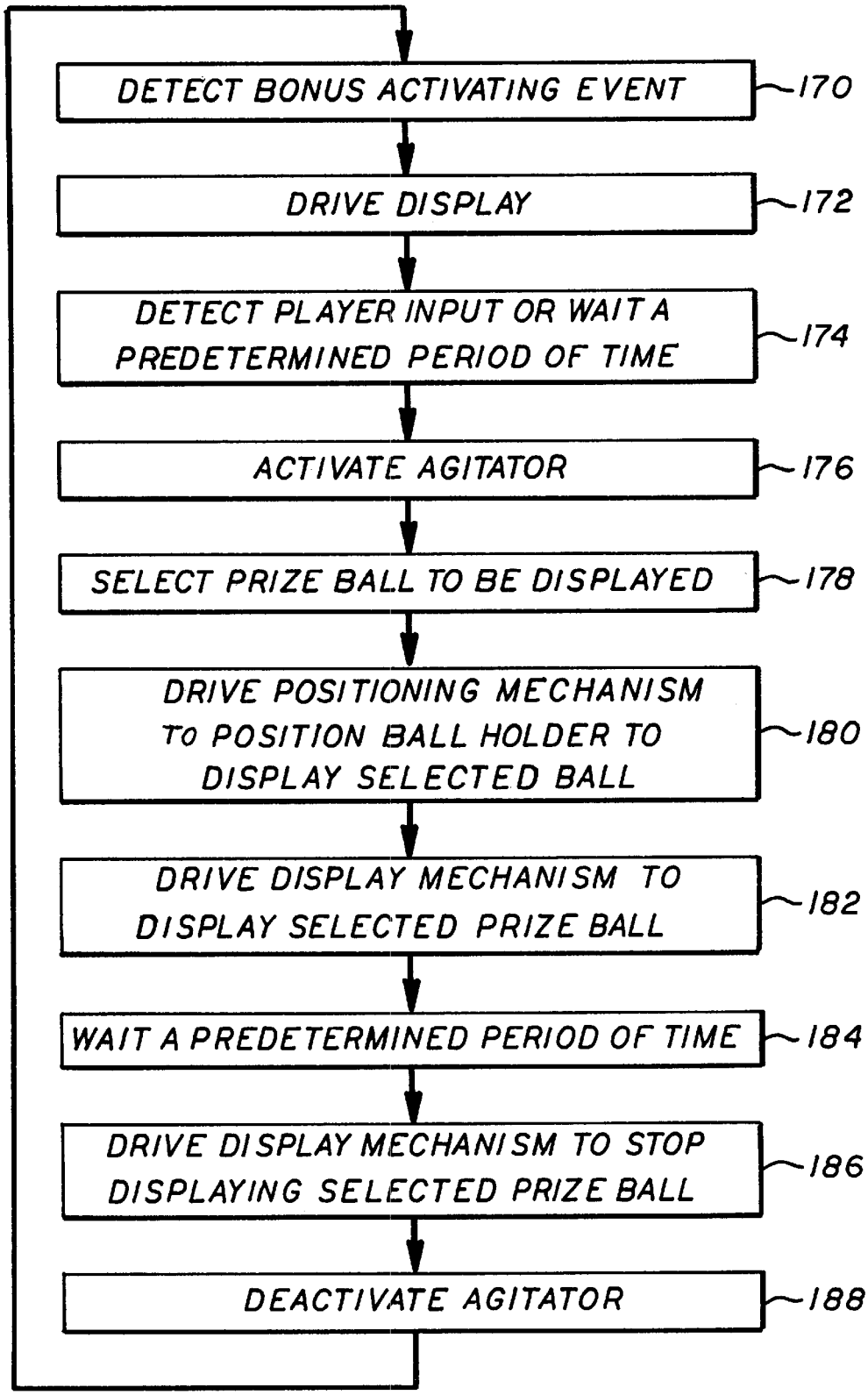
FIG. 2B is substantially a flow chart of the operation of the ball selector and display device of the present invention.

Turning now to FIG. 2B, the operation of ball selector and display device 14 begins when controller 76 detects a bonus activating event 170. Controller 76 may then drive display 110 to display an appropriate presentation or message 172. As discussed above, controller 76 may wait for player input or it may wait for a predetermined period of time 174. At some point, controller 76 activates the agitator 176 and selects a prize ball to be displayed 178. Controller 76 then drives positioning mechanism 77 to position ball holder 58 so that the selected prize ball may be displayed 180 and drives display mechanism 29 to display the selected ball 182. Controller 76 may then wait a predetermined period of time so that the player may see the displayed prize ball 184, after which it drives display mechanism 29 to stop displaying the selected prize ball 186. The agitator is then deactivated 188 and controller 76 returns to a monitoring state to detect the next bonus activating event 170.

Bingo

A number of games have been developed to take advantage of the unique features of indicator 14 of the present invention. As seen in FIG. 8, one of the games of the present invention comprises a bingo card 200 that may be displayed by a display device, such as an LCD, LED, CRT, or backlit translucent material. The horizontal axis of the card may comprise alphabetic or numeric characters 202 and the vertical axis of the card may comprise colors 204. The alphanumeric characters and the colors may be randomly arranged for each new game, thereby adding variety to the game.

In the Bingo embodiment, selector and display device 14 comprises two display windows 208 and 210. Each display window 208 and 210 may have its own individual ball holder 58 and prize balls 92 (not shown in FIG. 8). Ball display 208 corresponds to the vertical axis with balls 212 therein displaying colors and ball display 210 corresponds to the horizontal axis with balls therein displaying alphabetic or numeric characters.

In this game, the player wins a bonus prize by filling all of the spaces in a row, column, diagonal line, or combination of rows, columns, and diagonal lines with a symbol. For example, when the player qualifies for a bonus award, selector and display device 14 may randomly select and display a green ball 212 and a ball 214 with the letter "B" on it. A symbol 206 may then be displayed in the space where the "B" column and the green row intersect. Play would continue in this way until the player wins a prize. Once a prize is won, card 200 may be cleared so that the bonus game may be replayed.

An alternative embodiment of the Bingo bonus game is disclosed in FIG. 9. In this embodiment, a bingo card 230 displays a plurality of symbols. The symbols may be randomly arranged on card 230 for each game. When display window 30 displays a ball 92, displaying a symbol thereon, a symbol 236 is placed on the corresponding space on bingo card 230.

Figure 10:
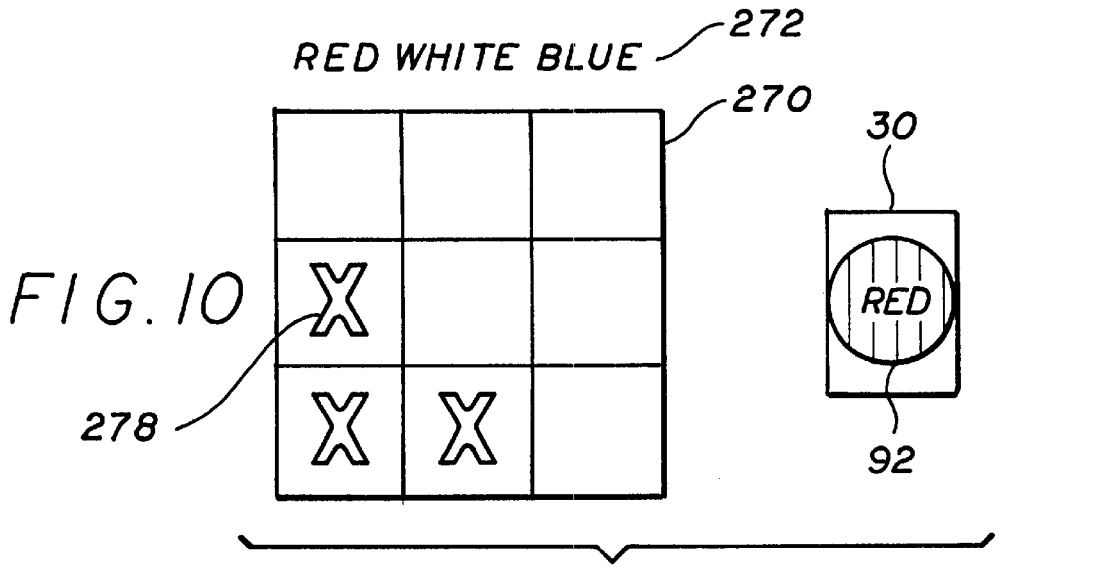
FIG. 10 is substantially a schematic representation of an alternative bingo game that may be used with the present invention.

In another embodiment, shown in FIG. 10, card 270 is divided into a plurality of columns. Each column corresponds with a particular type of symbol or color. The columns preferably have labels 272 on a horizontal axis. As indicator 14 displays a ball 92 in display window 30, a symbol 278 is placed in a space in the column that corresponds to the symbol on the ball. In this embodiment, the player is awarded a prize when all of the spaces in at least one column are filled. Card 270 is then cleared so that play can repeat.

Of course, many different variations of the Bingo bonus game may be utilized with the present invention. For example, larger or smaller cards and different symbols or combination of symbols may be used with the invention.

Lottery

Figure 11:
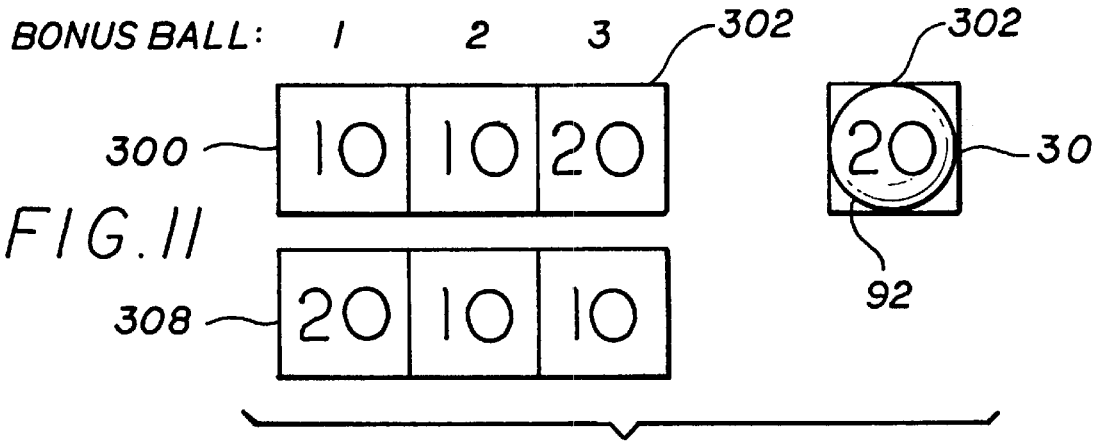
FIG. 11 is substantially a schematic representation of a lottery style game that may be used with the present invention.

The present invention also includes a game that follows a format similar to a lottery game. In this embodiment, seen in FIG. 11, prize ball 92 is selected and displayed in display window 30 in the same manner as other embodiments discussed above. Each time a ball is selected, a symbol 302 on the prize ball 92 is recorded in a first symbol display 300. In the example shown in FIG. 11, the number "10" has been recorded in the first and second areas for balls that have been previously selected and the number "20" is displayed in the third area for the most recent ball 92 selected. A second symbol display 308 is provided for displaying a randomly selected set of numbers. The numbers displayed in second display 308 may be generated with a random number generator that is adapted to select only the numbers that may be displayed on prize balls 92. Alternatively, similar to well known lottery games, the player may be allowed to pick the numbers in display 308. Of course, a greater or lesser number of spaces may be provided in displays 300 and 308.

In the preferred embodiment, the player is paid the amount shown on each prize ball 92 as it is displayed. Thus, in the example in FIG. 11, the player would be paid 20 credits or dollars for number 302 that is presented on the currently displayed ball 92. In addition to the prize displayed on ball 92, the player may qualify for an additional amount if the symbols displayed in first symbol display 300 are the same as the symbols displayed in second symbol display 308. In one embodiment, the symbols in first symbol display 300 must be in the same order as the symbols displayed in second symbol display 308. Thus, in the example shown in FIG. 11 the player would not win a prize because the order of the numbers are not the same. In another embodiment, the order of the numbers is irrelevant. Thus, in the example shown in FIG. 11 the player would win a prize because the symbols in first symbol display 300 are the same as the symbols in second symbol display 308. A modified version of the second embodiment would award a larger prize to the player if the order of the numbers in the two displays 300 and 308 where the same. In yet another embodiment, the prize that is awarded to a player is a progressive jackpot of a type that is well known in the art.

Player Selection

Figure 12:
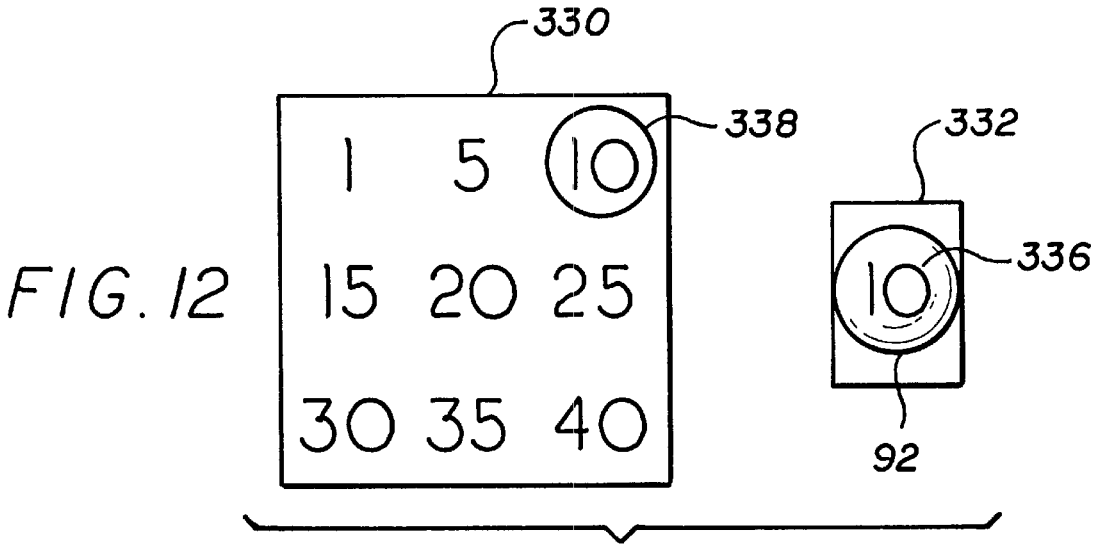
FIG. 12 is substantially a schematic representation of a player selection game that may be used with the present invention.

In another game of the present invention, the player selects a symbol or symbols from a list of symbols that the player may receive. Illustrated in FIG. 12, a display device 330 may be provided that displays a plurality of different symbols. When the game begins, the player may be prompted to select one of the possible symbols. In the case of a touch screen, the player may select the symbol by pressing the symbol with the player's finger. Other selection devices, such as buttons, may also be used. A graphical indicator may be used to indicate that the symbol has been selected, such as a circle 338 around the symbol. Once the symbol has been selected, the selector and display device 14 selects a ball and displays it in display window 30. If a symbol 336 on ball 92 matches the symbol selected by the player, the player is awarded a prize. In an alternative embodiment, the player is awarded the prize shown on the ball and the player receives an additional prize if the symbol on the ball matches the symbol selected by the player.

The player selection embodiment of the present invention may be combined with the lottery embodiment of the present invention. In this combination, the player is asked to select a plurality of numbers. If the symbols on the balls selected by selection and display device 14 are the same as the symbols selected by the player, the player is awarded a prize.

One of the advantages of providing the games discussed above is to increase the excitement and enjoyment of playing gaming device 10. Not only are the games entertaining to view, but they also increase the excitement and enjoyment experienced by players by offering large prizes. Each of the games can be adapted to award large prizes because they are capable of producing low probability events from which the large prizes are awarded.

In addition, the games of the present invention may be adapted for use as the primary game. Thus, game apparatus 20 may be completely replaced with the games of the present invention.

SUMMARY

Although the description above contains many specifications, these should not be construed as limiting the scope of the invention but as merely providing illustrations of some of presently preferred embodiments of this invention. The specification, for instance, makes reference to bonus prizes. However, the present invention is not intended to be limited to bonus prizes. Rather it is intended that the present invention be used independently as a stand-alone game. Thus, the scope of the invention should be determined by the appended claims and their legal equivalents rather than by the examples given.

What is claimed is:

1. A gaming device, the gaming device comprising:

(A) a game apparatus, the game apparatus being adapted to allow a player to play a game;

(B) a plurality of display balls;

(C) at least one container, the container being adapted to hold the display balls, the container having at least one portion that is at least partially transparent, wherein the player may view the display balls in the container;

(D) at least one agitator, the agitator being adapted to agitate the display balls inside of the container;

(E) a plurality of prize balls;

(F) at least one ball holder, the ball holder being adapted to hold the prize balls in an individually controlled manner, wherein prize balls in the ball holder are hidden from view of the player;

(G) a controller in communication with the game apparatus, the controller being adapted to select at least one prize ball in the holder; and (H) a display mechanism in communication with the controller, the display mechanism being adapted to display the selected prize ball to the player.

2. The gaming device of claim 1 further comprising a positioning mechanism in communication with the controller and attached to the ball holder, the positioning mechanism being adapted to position the selected prize ball relative to the display mechanism, whereby the display mechanism may display the selected ball.

3. The gaming device of claim 1 wherein the game apparatus is adapted to produce a bonus activating event.

4. The gaming device of claim 1 wherein the controller is adapted to detect a bonus activating event.

5. The gaming device of claim 4 wherein the bonus-activating event is at least one predetermined outcome of the game apparatus.

6. The gaming device of claim 4 wherein the controller is further adapted to activate the agitator after the controller detects a bonus-activating event.

7. The gaming device of claim 1 further comprising an input device in communication with the controller, the input device being adapted to enable the controller to cause the display the selected prize ball when the player activates the input device.

8. The gaming device of claim 7 wherein the controller is adapted to detect a bonus activating event, wherein the input device is enabled after the controller has detected a bonus activating event.

9. The gaining device of claim 8 wherein the controller automatically causes the display of the selected prize ball if the player does not activate the input device within a predetermined time period after a bonus-activating event has been detected by the controller.

10. The gaming device of claim 1 wherein the selected prize ball displayed by the display mechanism determines a prize to be awarded to the player.

11. The gaming device of claim 1 wherein the game apparatus is further adapted to award a prize, wherein the ball displayed by the display mechanism determines a bonus prize to be awarded to the player in addition to the prize awarded by the game apparatus.

12. The gaming device of claim 1 wherein the game apparatus is further adapted to award a prize and the ball displayed by the display mechanism determines a multiplier, the player being awarded a multiple of the prize awarded by the game apparatus.

13. A display device for playing a game, the display device comprising:

(A) a plurality of display balls;

(B) at least one container, the container being adapted to hold the display balls, the container comprising a wall, at least a portion of the wall being at least partially transparent, wherein a player can view all of the display balls in the container;

(C) at least one agitator, the agitator being adapted to agitate the display balls inside of the container;

(D) a plurality of prize balls;

(E) a ball holder, the ball holder being adapted to hold the prize balls in an individually controlled manner, wherein prize balls in the ball holder are hidden from view of the player;

(F) a controller, the controller being adapted to select a prize ball in the holder; and (G) a display mechanism, the display mechanism being adapted to communicate with the controller and display the selected prize ball to the player.

14. The display device of claim 13 further comprising a positioning mechanism in communication with the controller, the positioning mechanism being adapted to position the selected prize ball relative to the display mechanism, whereby the display mechanism may display the selected prize ball.

15. The display device of claim 13 wherein the agitator comprises an air blower.

16. The display device of claim 15 wherein the display mechanism comprises an air duct, the air duct conducting a stream of air from the container to the ball holder, wherein the selected prize ball is moved by the stream of air.

17. The display device of claim 13 wherein the controller is adapted to activate the agitator.

18. The display device of claim 17 wherein the controller is adapted to activate the agitator before the selected prize ball is displayed by the display mechanism.

19. The display device of claim 13 wherein the selected prize ball appears to originate from the jumbled ball display.

20. The display device of claim 13 wherein the ball holder comprises a plurality of chambers each chamber being adapted to hold a prize ball.

21. A display device for playing a game, the display device comprising:

(A) a plurality of prize balls;

(B) a ball holder, the ball holder being adapted to hold the prize balls in an individually controlled manner, wherein prize balls in the ball holder are hidden from view of the player;

(C) a controller, the controller being adapted to select a prize ball in the holder;

(D) a display mechanism, the display mechanism being adapted to communicate with the controller and display the selected prize ball to the player;

(E) a plurality of display balls;

(F) at leant one container, the container being adapted to hold the display balls, the container comprising a wall, at least a portion of the wall being at least partially transparent, wherein a player can view the display balls in the container; and (G) at least one agitator, the agitator being adapted to agitate the display balls inside of the container.

22. The display device of claim 21 further comprising a positioning mechanism in communication with the controller, the positioning mechanism being adapted to position the selected prize ball relative to the display mechanism, whereby the display mechanism may display the selected ball.

23. The display device of claim 21 wherein the ball holder comprises at least one chamber, is the chamber being adapted to hold at least one ball.

24. The display device of claim 23 wherein the ball holder is cylindrical, the chamber being positioned outwardly from a central axis of the ball holder.

25. The display device of claim 23 wherein the chamber comprises an opening, the opening being adapted to allow the ball to be removed from the chamber.

26. The display device of claim 25 wherein the opening is located on a lower surface of the ball holder, wherein the display mechanism further comprises a gate, the gate being adapted to selectively allow the selected prize ball to fall out of the chamber.

27. The display device of claim 26 wherein the display mechanism comprises a display window, the display window being positioned below the chamber and adapted to receive the selected prize ball.

28. The display device of claim 27 further comprising a blower, the blower being adapted to produce a stream of air in the display window, wherein the stream of air lifts the selected prize ball into the chamber.

29. A method of playing a game with a player, the method comprising the following steps:

(A) providing a plurality of prize balls;

(B) storing the prize balls in an individually controlled manner, the stored prize balls being hidden from view of the player;

(C) selecting a prize ball;

(D) displaying the selected prize ball to the player;

(E) providing a jumbled ball display, the display comprising a container and a plurality of display balls in the container, the container permitting the player to see the display balls;

(F) jumbling the balls in the container; and (G) allowing the player to view the display balls as there are jumbled.

30. The method of claim 29 wherein the selected prize ball is selected based at least in part on a random event.

31. The method of claim 30 further comprising the step of awarding a prize to the player based at least in part on the random event.

32. The method of claim 29 wherein the selected prize ball displayed to the player appears to originate from the jumbled ball display.

33. A method of playing a game with a player, the method comprising the following steps:

(A) providing a jumbled ball display, the display comprising a container and a plurality of display balls in the container, the container allowing the player to see the display balls;

(B) jumbling the balls in the container and allowing the player to view the display balls as the display balls are jumbled;

(C) providing a plurality of prize balls, the prize balls being separated from the jumbled ball display;

(D) selecting a prize ball;

(E) displaying the selected prize ball to the player; and (F) storing the prize balls in an individually controlled manner, the stored prize balls being hidden from view of the player and only the selected prize ball being viewable by the player.

34. The method of claim 33 wherein the selected prize ball appears to the player to originate from the jumbled ball display.

35. The method of claim 33 further comprising the step of generating a predetermined event before displaying the selected prize ball.

36. The method of claim 33 further comprising the step of awarding a prize to the player.

37. The method of claim 36 wherein the prize awarded to the player is related to the selected prize ball.

38. The method of claim 33 wherein the step of selecting a prize ball comprises randomly selecting the prize ball.

39. The method of claim 38 wherein the step of randomly selecting the prize ball comprises generating a random number.

* * * * *